US009383067B2

(12) United States Patent
Kreuzbichler

(10) Patent No.: US 9,383,067 B2
(45) Date of Patent: Jul. 5, 2016

(54) LIGHT-EMITTING MEANS, IN PARTICULAR LED MODULE

(71) Applicant: Tridonic GmbH & Co KG, Dornbirn (AT)

(72) Inventor: Jurgen Kreuzbichler, Absam (AT)

(73) Assignee: TRIDONIC GMBH & CO KG, Dornbirn (AT)

( * ) Notice: Subject to any disclaimer, the term of this patent is extended or adjusted under 35 U.S.C. 154(b) by 0 days.

(21) Appl. No.: 14/651,283

(22) PCT Filed: Dec. 10, 2013

(86) PCT No.: PCT/AT2013/000199

§ 371 (c)(1),
(2) Date: Jun. 11, 2015

(87) PCT Pub. No.: WO2014/094006

PCT Pub. Date: Jun. 26, 2014

(65) Prior Publication Data

US 2015/0316244 A1 Nov. 5, 2015

(30) Foreign Application Priority Data

Dec. 21, 2012 (AT) ..... GM 481/2012

(51) Int. Cl.

| | |
|---|---|
| ***F21V 23/06*** | (2006.01) |
| ***F21K 99/00*** | (2016.01) |
| ***F21V 15/01*** | (2006.01) |
| *F21Y 101/02* | (2006.01) |
| *F21Y 105/00* | (2016.01) |

(52) U.S. Cl.
CPC ... *F21K 9/00* (2013.01); *F21K 9/30* (2013.01); *F21V 15/013* (2013.01); *F21V 23/06* (2013.01); *F21Y 2101/02* (2013.01); *F21Y 2105/001* (2013.01)

(58) Field of Classification Search
CPC ..... F21V 23/06; F21V 15/013; F21K 9/30
See application file for complete search history.

(56) References Cited

U.S. PATENT DOCUMENTS

| | | | | |
|---|---|---|---|---|
| 2004/0240229 | A1* | 12/2004 | Blumel | F21K 9/00 362/555 |
| 2012/0020086 | A1 | 1/2012 | Kataoka | |
| 2012/0293997 | A1 | 11/2012 | Zaderej | |
| 2014/0240966 | A1* | 8/2014 | Garcia | H02J 7/0086 362/183 |

FOREIGN PATENT DOCUMENTS

| | | | |
|---|---|---|---|
| DE | 20321643 | U1 | 8/2008 |
| DE | 102011015968 | A1 | 10/2012 |

(Continued)

*Primary Examiner* — Elmito Breval
(74) *Attorney, Agent, or Firm* — Volpe and Koenig, P.C.

(57) ABSTRACT

Light-emitting means, in particular LED module (2), having a printed circuit board (7) comprising at least one LED, wherein the light-emitting means has at least one housing (3), wherein the housing (3) is in the form of an injection-molded part and covers the printed circuit board (7), wherein the housing (3) has an opening (6), and the LEDs are arranged within this opening (6), with the result that the LEDs can emit light out of the housing (6), wherein the printed circuit board (7) has at least two plug-type connections (8), wherein the plug-type connections (8) are each configured so as to make contact with a conductor, wherein in each case one pushbutton (9) is arranged above the plug-type connections (8), which pushbutton is configured for releasing the conductor from the plug-type connection (8), wherein the pushbuttons (9) are formed as part of the housing (3).

10 Claims, 2 Drawing Sheets

(56) References Cited

FOREIGN PATENT DOCUMENTS

| | | | |
|---|---|---|---|
| DE | 102011076300 | A1 | 11/2012 |
| EP | 1152489 | A2 | 11/2011 |
| EP | 2492588 | A1 | 8/2012 |
| GB | 2452637 | A | 3/2009 |
| WO | 2011088212 | A2 | 7/2011 |

* cited by examiner

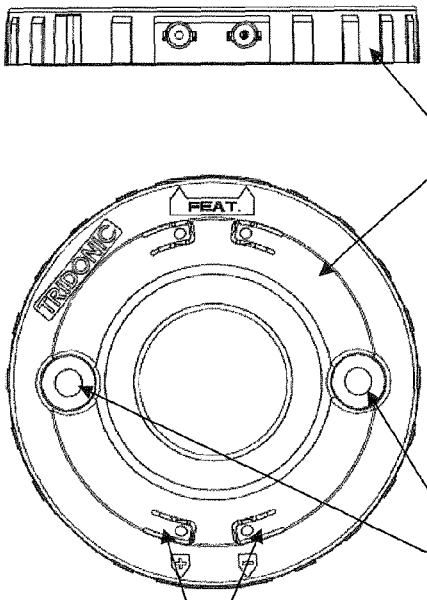
Fig. 2
Fig. 3
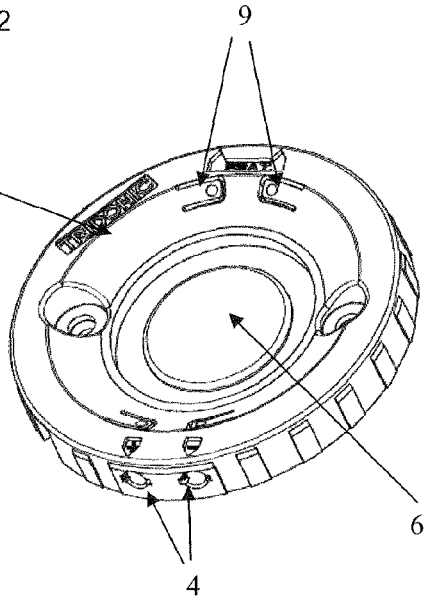
Fig. 4
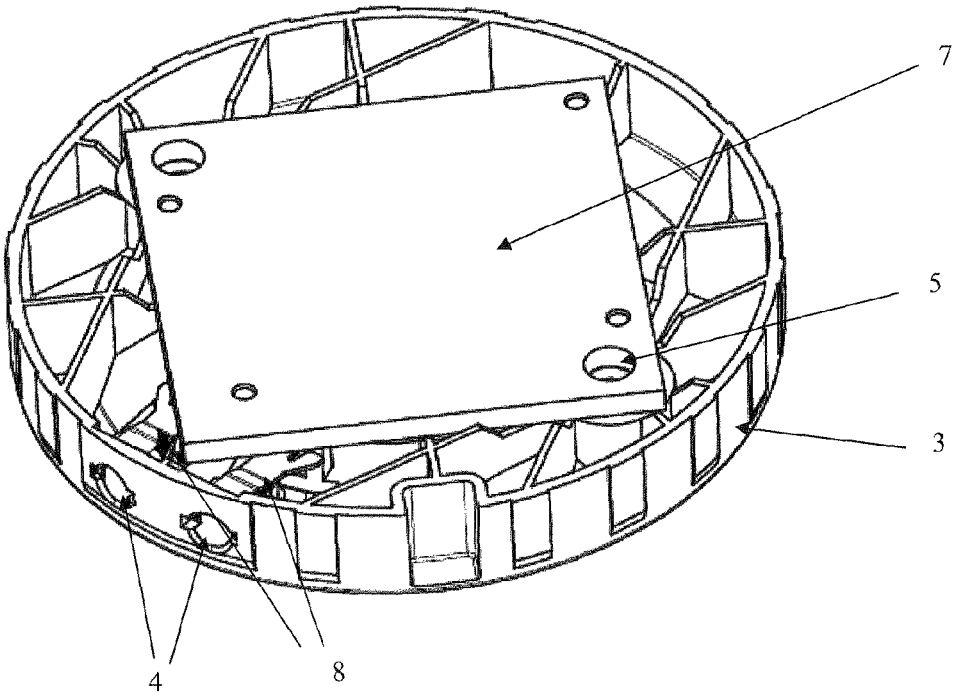
Fig. 5

LIGHT-EMITTING MEANS, IN PARTICULAR LED MODULE

FIELD OF THE INVENTION

The invention relates to light-emitting means, in particular an LED module.

BACKGROUND

Such devices serve the purpose of making at least a light-emitting means and/or a light-emitting module, in particular an LED module, possible in a compact structural form. Such light-emitting means can be arranged in a luminaire, preferably in a reflector lamp.

Devices referred to as LED modules, also as LED light engines, are known from the prior art. Such LED modules often have a housing, which serves as mechanical protection and at the same time facilitates mounting. These housings make it possible for example for the rear side of the LED module to be fastened on a surface of a heat sink. The device has a housing and at least one possibility for fastening a connector, for example a flat connector.

An LED module is described in DE20321643 U1. However, this module has fixedly contacted conductors, which cannot be detached from the LED module.

The object of the invention is to provide an LED module as a light-emitting means that has a compact structural form and with which contact can easily be made.

SUMMARY

This object is achieved according to the invention by the features specified in the independent claims.

The invention also relates to a light-emitting means or a light-emitting module, in particular an LED module, and also to a luminaire with the device according to the invention.

BRIEF DESCRIPTION OF THE DRAWINGS

The invention is described in more detail below on the basis of exemplary embodiments, which however are only given by way of example but are not intended to be interpreted as restrictive.

In the drawings:

FIG. 2 shows a side view of the LED module according to the invention

FIG. 3 shows a further view of the LED module according to the invention

FIG. 4 shows a further view of the LED module according to the invention

FIG. 5 shows a view of the rear side of the LED module according to the invention

DETAILED DESCRIPTION OF THE PREFERRED EMBODIMENTS

Figure 1:
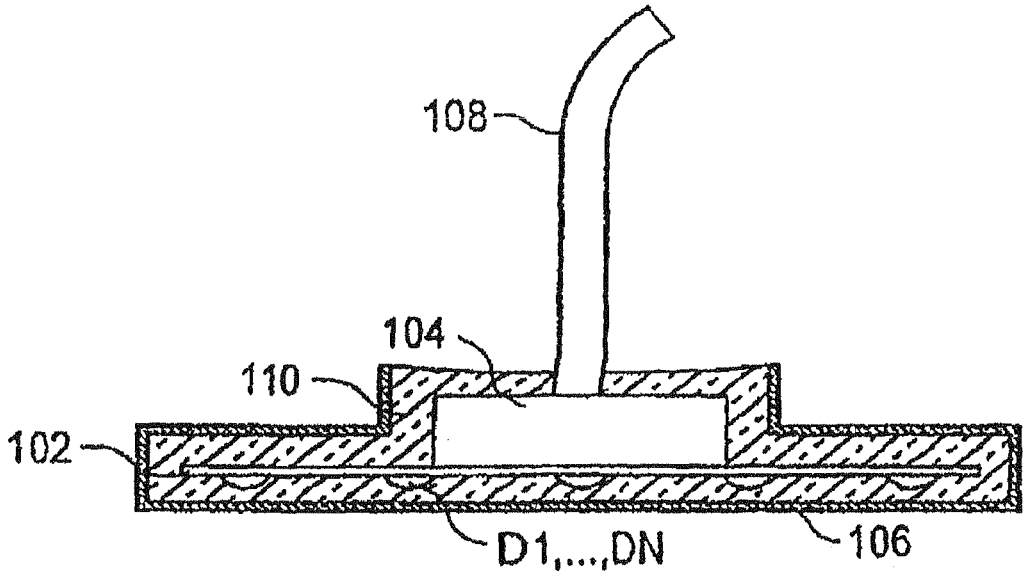
FIG. 1 shows a view of an LED module according the prior art

In FIG. 1 there is shown an LED module according to the prior art, as disclosed for example in DE20321643 U1.

In FIG. 2 there is shown a light-emitting means 1 according to the invention, in particular an LED module. Only LED modules are described here, but it should not be ruled out that other light-emitting means or light-emitting modules can be used.

The LED module may for example be fastened on a heat sink that is not shown here; such heat sinks are usually part of a luminaire. Here, this could be a downlight luminaire (spotlight). Other types of luminaire should nevertheless not be excluded from this invention.

Heat sinks are preferably made of aluminum and are necessary when using LEDs or LED modules in order to allow the heat generated by the LEDs to be dissipated.

In FIGS. 2 to 4, a first variant of the device 1 according to the invention is shown.

The light-emitting means, in particular LED module 2, has a printed circuit board with at least a first LED. The light-emitting means has a housing 3, which is formed as an injection-molded part and covers the printed circuit board 7. The housing 3 preferably has a round form, but may for example also be formed in a rectangular or octagonal manner. The housing 3 has an opening 6, and LEDs are arranged within this opening 6, so that the LEDs can radiate light out of the housing 3. The printed circuit board 7 has at least two plug-in connections 8, the plug-in connections 8 being respectively designed for the contacting of a conductor. A pushbutton 9, which is designed for releasing the conductor from the plug-in connection 8, is respectively arranged above the plug-in connections 8 as an actuating element. The pushbuttons 9 are formed as part of the housing 3.

The pushbuttons 9 and the housing 3 are preferably formed in one piece and as a plastic housing. Preferably, each pushbutton 9 has a pushbutton arm. Preferably, the pushbutton 9 is arranged in such a way that the pushbutton arm extends with parallel to an outer edge of the housing 3.

In a first embodiment, the light-emitting means has two plug-in connections 8. In an alternative embodiment, the light-emitting means has four plug-in connections 8. The plug-in connections 8 may be designed for the contacting of rigid, multi-wired and/or flexible conductors.

The housing 3 preferably has a round structural form and the plug-in connections 8 may be integrated completely in the round structural form. The housing may have clearances 4 in the region of the plug-in connections. The conductor may be respectively inserted into the clearance 4, the clearances 4 at the same time forming an insertion region for the conductor.

The opening 6 in the housing 3 may have holding means for a lens or other secondary optics, in particular a diffusing screen.

At least two plug-in connections 8 are electrically connected to the first LED or a first group of LEDs on the printed circuit board 7. In the case of the embodiment with at least four plug-in connections 8, two further plug-in connections 8*b* may be electrically connected to a second LED or a second group of LEDs on the printed circuit board, this second LED being electrically separate from the first LED. This second LED may for example be an LED that is only operated in the case of emergency light, while the first LED is intended for normal operation.

There may also be at least two further plug-in connections 8*c* electrically connected to a thermal sensor arranged on the printed circuit board.

The housing 3 preferably has fastening means 5 for fastening on a heat sink. The housing 3 may be fastened on the heat sink. The connection to the heat sink may for example take place with the aid of the fastening means 5. For this purpose, screw holes may be provided in the housing 3, for fastening screws that are not shown here. The fastening means 5 are preferably regularly distributed on the housing 3, and such fastening means may also be distributed on the heat sink, accordingly in a way matching the fastening means of the housing 3. As a result, the LED module may be fixedly or rigidly connected to the heat sink.

The pushbuttons 9 make it possible for contact between the LED module 2 and the conductors to be made without any tools and in an easy manner. This produces the advantage that the light-emitting means, in particular LED module 2, can be contacted in an easy way and the conductors can also be easily detached again if necessary. The light-emitting means may remain in its mounted state. It facilitates mounting and removal for trained personnel, especially if the light-emitting means, in particular LED module, is intended for a reflector lamp.

The embodiments that are shown in the figures are only examples of the invention. Further embodiments that are not shown here should not be ruled out.

What is claimed is:

1. A light-emitting means (2), comprising a printed circuit board (7) with at least one LED, and at least one housing (3), the housing (3) being formed as an injection-molded part and covering the printed circuit board (7), the housing (3) comprising an opening (6), and the at least one LED being arranged within this opening (6), so that the at least one LED can radiate light out of the housing (6), the printed circuit board (7) comprising at least two plug-in connections (8), the at least two plug-in connections (8) being respectively configured to each contact a conductor, a pushbutton (9), configured to release the conductor from the plug-in connection (8), being respectively arranged above the at least two plug-in connections (8) the pushbuttons (9) being formed as part of the housing (3).

2. The light-emitting means (2), as claimed in claim 1, wherein the pushbuttons (9) and the housing (3) are formed in one piece as a plastic housing.

3. The light-emitting means (2), as claimed in claim 1, wherein the light-emitting means has at least four plug-in connections (8).

4. The light-emitting means (2), as claimed in claim 1, wherein the plug-in connections (8) are configured to contact rigid, multi-wired and/or flexible conductors.

5. The light-emitting means (2), as claimed in claim 1, wherein the housing (3) has a round structural form and the plug-in connections (8) are integrated completely in the round structural form.

6. The light-emitting means (2), as claimed in claim 1, wherein the housing (3) has a fastener (5) for fastening the housing (3) on a heat sink.

7. The light-emitting means (2), as claimed in claim 1, wherein the opening (6) in the housing (3) comprises a support that holds a lens or a diffusing screen.

8. The light-emitting means (2), as claimed in claim 1, wherein at least two plug-in connections (8) are electrically connected to a first LED on the printed circuit board (7).

9. The light-emitting means (2), as claimed in claim 8, wherein at least two further plug-in connections (8*b*) are electrically connected to a second LED on the printed circuit board (7), the second LED being electrically separate from the first LED.

10. The light-emitting means (2), as claimed in claim 1, wherein at least two plug-in connections (8) are electrically connected to a thermal sensor arranged on the printed circuit board (7).

* * * * *